US009135882B2

(12) United States Patent
Zhang et al.

(10) Patent No.: US 9,135,882 B2
(45) Date of Patent: Sep. 15, 2015

(54) DATA DRIVER CIRCUIT HAVING COMPENSATION MODULE, LCD DEVICE AND DRIVING METHOD

(71) Applicant: SHENZHEN CHINA STAR OPTOELECTRONICS TECHNOLOGY CO., LTD, Shenzhen (CN)

(72) Inventors: Yong Zhang, Shenzhen (CN); Xiaoping Tan, Shenzhen (CN); Jiehui Qin, Shenzhen (CN)

( * ) Notice: Subject to any disclaimer, the term of this patent is extended or adjusted under 35 U.S.C. 154(b) by 391 days.

(21) Appl. No.: 13/807,704

(22) PCT Filed: Dec. 18, 2012

(86) PCT No.: PCT/CN2012/086889
§ 371 (c)(1),
(2) Date: Dec. 28, 2012

(87) PCT Pub. No.: WO2014/089857
PCT Pub. Date: Jun. 19, 2014

(65) Prior Publication Data

US 2014/0168043 A1 Jun. 19, 2014

(30) Foreign Application Priority Data

Dec. 14, 2012 (CN) ..... 2012 1 0541232

(51) Int. Cl.
*G09G 3/36* (2006.01)

(52) U.S. Cl.
CPC ..... *G09G 3/3692* (2013.01); *G09G 2320/0209* (2013.01); *G09G 2320/0276* (2013.01)

(58) Field of Classification Search
CPC ..... G09G 3/3692; G09G 2320/0276; G09G 2320/0209
USPC ..... 345/90
See application file for complete search history.

(56) References Cited

U.S. PATENT DOCUMENTS 5,926,157 A 7/1999 Moon
7,148,827 B2 12/2006 Lee (Continued)

FOREIGN PATENT DOCUMENTS

CN 1050298 A 3/1991
CN 1949355 A 4/2007

(Continued)

OTHER PUBLICATIONS

Nastase, Adrian,. How to Derive the Summing Amplifier Transfer Function. Mastering Electronics Design [online], Jul. 9, 2009, [retrieved Mar. 20, 2015]. Retrieved from the Internet <URL: https://web.archive.org/web/20100310020639/http://masteringelectronicsdesign.com/how-to-derive-the-summing-amplifier-transfer-function>.*

(Continued)

*Primary Examiner* — Jonathan Blancha

(57) ABSTRACT

The present disclosure provides a data driver circuit, a liquid crystal display (LCD) device, and a driving method. The data driver circuit for an LCD panel includes a source driver module, a pixel electrode, a common electrode opposite to the pixel electrode, and a gamma calibration module coupled to the source driver module. The source driver module is coupled to the pixel electrode. The data driver circuit further includes a compensation module. The compensation module detects and obtains a changed voltage of the common electrode voltage to generate a compensation voltage, and combines the compensation voltage and the gamma voltage of the gamma calibration module, then sends the combined voltage to the source driver module. The compensation voltage output by the compensation module and the changed voltage of the common electrode voltage can be mutually counteracted.

14 Claims, 2 Drawing Sheets

(56) References Cited

U.S. PATENT DOCUMENTS

| | | | | |
|---|---|---|---|---|
| 2004/0233182 | A1* | 11/2004 | Chuang et al. | 345/204 |
| 2007/0024560 | A1 | 2/2007 | Kim et al. | |
| 2008/0303967 | A1* | 12/2008 | Huang et al. | 349/39 |
| 2010/0033413 | A1* | 2/2010 | Song et al. | 345/89 |

FOREIGN PATENT DOCUMENTS

| | | | |
|---|---|---|---|
| CN | 101082710 | A | 12/2007 |
| CN | 101320550 | A | 12/2008 |
| CN | 101694765 | A | 4/2010 |
| CN | 102183852 | A | 9/2011 |

OTHER PUBLICATIONS

Nastase, Adrian,. How to Derive the Differential Amplifier Transfer Function. Mastering Electronics Design [online], May 7, 2009, [retrieved Mar. 20, 2015]. Retrieved from the Internet <URL: https://web.archive.org/web/20100325234541/http://masteringelectronicsdesign.com/the-differential-amplifier-transfer-function>.*

Wang Ji, the International Searching Authority written comments, Sep. 2013, CN.

* cited by examiner

DATA DRIVER CIRCUIT HAVING COMPENSATION MODULE, LCD DEVICE AND DRIVING METHOD

TECHNICAL FIELD

The present disclosure relates to the field of liquid crystal displays (LCDs), and more particularly to a data driver circuit, an LCD device, and a driving method.

BACKGROUND

A liquid crystal display (LCD) device includes an LCD panel, and a backlight module that provides a light source for the LCD panel. The LCD panel includes a plurality of pixel electrodes and common electrodes opposite to the pixel electrodes. A pixel capacitor is formed between a pixel electrode and a common electrode, the pixel electrode is connected to a drain electrode of a thin film transistor (TFT), and liquid crystal (LC) molecules are arranged between two electrodes of the pixel capacitor. The LCD panel outputs different voltages to the drain electrode of the TFT so that the LC molecules have different deflection angles, and luminous flux corresponding to the deflection angles are different, which makes the LCD panel display images. The LCD panel further includes scan lines and data lines that cross each other. The scan lines are controlled by a scanning driver integrated circuit IC, and the data lines are controlled by a data driver IC. The scan lines controls switching of corresponding TFTs. When the TFTs are turned on, different driving voltages are output to the pixel electrodes by the data line, thus controlling display of the images of the LCD panel. To adjust applied voltage and display brightness linearity of the LCD panel, a gamma calibration circuit is often used. A gamma voltage output by the gamma calibration circuit is combined with an original data voltage to drive the data lines. Because there is a determined resistance in the circuit, a parasitic capacitance is formed between the data line and the common electrode. When a voltage of the data line is changed, potential of the common electrode is affected. If the resistance of the common electrode is too high, the potential of the common electrodes may not be returned to a set potential within short time, namely the voltage of the common electrode is not a stable fixed value any more, variation is produced around the fixed value, and the variation may produce crosstalk, resulting in decrease of image effects.

SUMMARY

In view of the above-described problems, the aim of the present disclosure is to provide a data driver circuit, a liquid crystal display (LCD) device, and a driving method thereof capable of reducing crosstalk.

The aim of the present disclosure is achieved by the following technical scheme.

A data driver circuit for an LCD panel comprises a source driver module, a pixel electrode, a common electrode opposite to the pixel electrode, and a gamma calibration module coupled to the source driver module; the source driver module is coupled to the pixel electrode. The data driver circuit further comprises a compensation module; the compensation module detects and obtains a changed voltage of the common electrode voltage to generate to compensation voltage, and combines the compensation voltage and the gamma voltage of the gamma calibration module, then the combined voltage is sent to the source driver module.

Furthermore, the compensation module comprises a comparator, and an output end of the comparator is coupled to the source driver module.

A first resistor and a second resistor are connected in series between a grounding end of the data driver circuit and the output end of the comparator.

An inverting input end of the comparator is coupled between the first resistor and the second resistor.

A third resistor is connected in series between a non-inverting input end of the comparator and the common electrode.

A fourth resistor is connected in series between the non-inverting input end of the comparator and the gamma voltage.

This is a specific circuit structure of the compensation module. One compensation module is constructed by using a comparator, and the gamma voltage and the common electrode voltage are connected to a same end of the comparator. Thus, because the condition that the gamma voltage is unchanged, the compensation module combines the changed voltage of the common electrode voltage and the gamma voltage, a voltage of the non-inverting input end of comparator is correspondingly changed, and the voltage of the comparator output to the source driver module is changed. Therefore, the source driver module outputs a driving voltage through the changed voltage to enable a voltage difference between the two electrodes of the pixel capacitor to be consistent.

Furthermore, resistance of the first resistor is equal to resistance of the second resistor, and resistance of the third resistor is equal to resistance of the fourth resistor. In the technical scheme, the output voltage of the comparator is equal to a sum of the gamma voltage and the changed voltage of the common electrode voltage, namely compensation is in the ratio of 1:1. Because the compensation voltage is equal to the changed voltage of the common electrode voltage, the source driver module can combine the output voltage of the comparator and the voltage of the data driver to drive corresponding data line without additional voltage conversion, which simplifies logical operation and reduces development difficulty.

Furthermore, a capacitor is connected in series between the third resistor and the common electrode. The changed voltage of the common electrode voltage is generated by the capacitor and is mainly consists of alternating current (AC) voltage. Thus, direct current (DC) voltage of the common electrode voltage is filtered by the capacitor, the AC voltage of the changed voltage is directly received, and interference of the DC voltage is eliminated, which makes feedback result accurate.

Furthermore, the gamma calibration module outputs at least two voltages, and the fourth resistor is coupled to the output end of the gamma calibration module that outputs the maximum gamma voltage. In practical application, there may be a plurality of gamma voltages. To reduced design difficulty, the gamma voltages can be appointed as one or several gamma voltages to be fed back to the comparator. For example, in the technical scheme, if only one gamma voltage is fed back, the maximum gamma voltage of the voltages is selected. Because all the gamma voltages are generally generated by a resistance division mode, when the maximum gamma voltage can be used to effectively compensate, the maximum gamin, voltage is indirectly compensated onto other gamma voltages, and then crosstalk is effectively reduced.

An LCD device comprises the data driver circuit for an LCD panel mentioned above.

1. A data driving method for an LCD panel comprises:

A. detecting and obtaining a changed voltage of a common electrode voltage to generate a compensation voltage;

B. combining, the compensation voltage on a gamma voltage, then sending the combined voltage to a source driver module.

Furthermore, in the step A, the common electrode voltage is filtered, and then the changed voltage of the common electrode voltage is calculated. The changed voltage of the common electrode voltage is generated by a capacitor and is mainly consists of alternating current (AC) voltage. Thus, direct current (DC) voltage of the common electrode voltage is filtered by the capacitor, the AC voltage of the changed voltage is directly received, and interference of the DC voltage is eliminated, which makes obtaining feedback results accurate.

Furthermore, in the step B, the compensation voltage is equal to the changed voltage of the common electrode voltage. In the technical scheme, because the compensation voltage is equal to the changed voltage of the common electrode voltage, the source driver module can combine the output voltage of the comparator and the voltage of the data driver to drive corresponding data line without additional voltage conversion, which simplifies logical operation and reduces development difficulty.

Furthermore, in the step B, there are at least two gamma voltages, and the compensation voltage and the gamma voltage are combined, then sending the combined voltage to the source driver module. In practical application, there may be a plurality of the gamma voltages. To reduce design difficulty, the gamma voltages can appointed as one or several gamma voltages to be fed back to the comparator. For example, in the technical scheme, if only one gamma voltage is fed back, the maximum gamma voltage of the voltages is selected. Because all the gamma voltages are generated by a resistance division mode, when the maximum gamma voltage can be used to effectively compensate, the maximum gamma voltage is indirectly compensated onto other gamma voltages, and then crosstalk is effectively reduced.

In the present disclosure, because the compensation module is used, a compensation voltage is generated by the compensation module in accordance with the changed voltage of the common electrode voltage, the compensation module combines the compensation voltage and the existing gamma voltage, and then is transmitted to the source driver module. The source driver module is coupled to the pixel electrode, a pixel capacitor is formed by the pixel electrode and the common electrode, and the deflection angle(s) of the LC molecules in the pixel capacitor is determined by the voltage difference between the two electrodes, namely the display gray scale of the pixel is reduced. Generally speaking, the common electrode voltage is constant, the source driver module adjusts the output voltage on the basis of the premise to control the voltage of the pixel electrode, thereby controlling the deflection angle of the LC molecules and achieving the expected display effect. When the capacitor coupling effect results in the fluctuation of the voltage of the common electrode on the panel, the common electrode abnormally fluctuates, and the voltage difference between the common electrode and the pixel electrode exceeds the preset value. At this moment, so long as the compensation module combines the corresponding compensation voltage on the existing gamma voltage, the voltage difference between the two electrodes of the pixel capacitor is kept to be unchanged, namely the compensation voltage and the variation of the voltage of the common electrode are mutually counteracted, and then crosstalk is prohibited from being generated.

DETAILED DESCRIPTION

Figure 1:
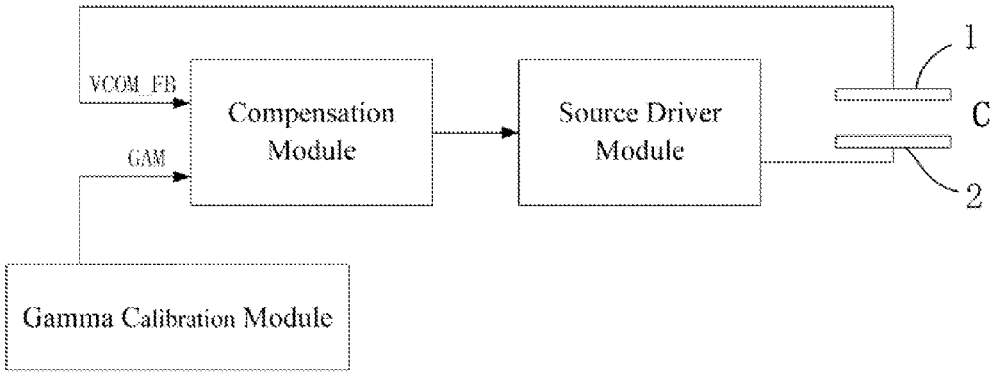
FIG. 1 is a schematic diagram of the present disclosure.

As shown in FIG. 1, the present disclosure provides a liquid crystal display (LCD) device comprises a data driver circuit for an LCD panel. The data driver circuit for an LCD panel comprises a pixel capacitor C, and a source driver module. The pixel capacitor C comprises a pixel electrode 2, a common electrode 1 opposite to the pixel electrode, and a gamma calibration module coupled to the source drive module. The source driver module is coupled to the pixel electrode 2. The data driver circuit further comprises a compensation module where the compensation module generates a changed voltage of the common electrode voltage VCOM_FB into a compensation voltage, and combines the compensation voltage and a gamma voltage of the gamma calibration module, which is sent to the source driver module.

In the present disclosure, because the compensation module is used, a compensation voltage is generated by the compensation module in accordance with the changed voltage of the common electrode voltage, the compensation module combines the compensation voltage and the gamma voltage of the gamma calibration module, and the combined voltage is sent to the source driver module. The source driver module is coupled to the pixel electrode, a pixel capacitor is formed between the pixel electrode and the common electrode, deflection angle of the LC molecules in the pixel capacitor is determined by a voltage difference between the two electrodes, namely a display gray scale of the pixel is reduced. Generally speaking, because voltage of the common electrode is constant, the source driver module adjusts the output voltage to control the voltage of the pixel electrode, thereby controlling the deflection angle of the LC molecules and achieving display effect of the LCD panel. When capacitor coupling effect results in fluctuation of the voltage of the common electrode on the LCD panel, the common electrode abnormally fluctuates, and the voltage difference between the common electrode and the pixel electrode exceeds the preset value. At this moment, so long as the compensation module combines the corresponding compensation voltage and the gamma voltage, the voltage difference between the two electrodes of the pixel capacitor is kept to be unchanged, namely the compensation voltage and the changed voltage of the common electrode voltage are mutually counteracted, which avoid generating crosstalk.

The present disclosure will further be described in detail in accordance with the figures and the examples.

Figure 2:
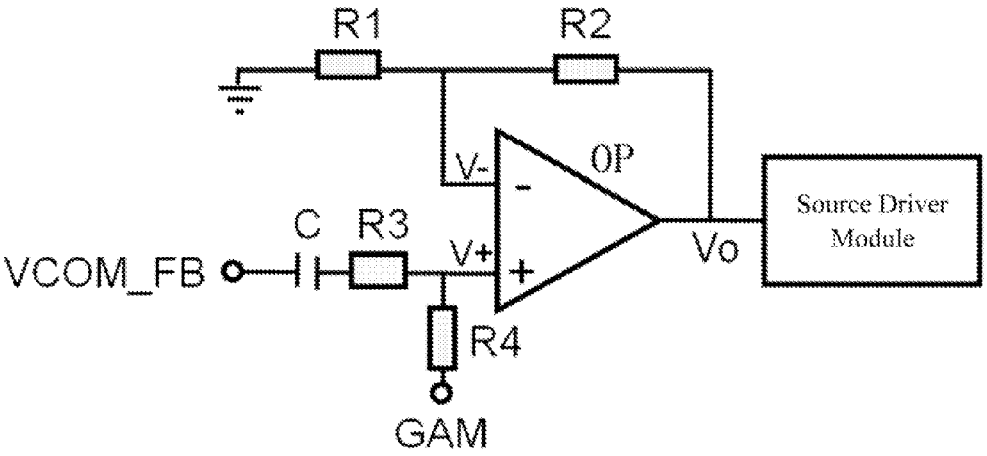
FIG. 2 is a schematic diagram of an example of the present disclosure.

As show FIG. 2, the example provides a data driver circuit for an LCD panel. The compensation module in the example comprises a comparator OP, where an output end of the comparator OP is coupled to the source driver module.

A first resistor R1 and a second resistor R2 are connected in series between a grounding end of the data driver circuit and the output end of the comparator OP.

An inverting input end of the comparator OP is coupled between the first resistor R1 and the second resistor R2.

A third resistor R3 and a capacitor C are connected in series between a non-inverting input end of the comparator OP and the common electrode voltage VCOM_FB.

A fourth resistor R4 is connected in series between the non-inverting input end of the comparator OP and the gamma voltage.

Resistance of the first resistor R1 is equal to resistance of the second resistor R2, and resistance of the third resistor R3 is equal to resistance of the fourth resistor R4.

The present disclosure provides a specific circuit structure of the compensation module. One compensation module is constructed using the comparator OP, and the gamma voltage and the common electrode voltage VCOM_FB are connected to the same end of the comparator OP. Thus, when the gamma voltage is unchanged, the changed voltage of the common electrode voltage VCOM_FB is combined with the gamma voltage, a voltage of the not-inverting input end of comparator OP is correspondingly changed, and the voltage that the comparator OP outputs to the source driver module is also changed. Therefore, the source driver module outputs a driving voltage through the changed voltage to enable voltage difference between the two electrodes of the pixel capacitor C to be consistent.

When the resistance of the first resistor R1 is equal to the resistance of the second resistor R2, and the resistance of the third resistor R3 is equal to the resistance of the fourth resistor R4, the output voltage of the comparator OP is equal to a sum of the gamma voltage and the changed voltage of the common electrode voltage VCOM_FB, namely compensation is in the ratio of 1:1. Because the compensation voltage is equal to the changed voltage of the common electrode voltage VCOM_FB, the source driver module can directly combine the output voltage of the comparator OP and the voltage of the data driver to drive corresponding data line without additional voltage conversion, which simplifies logical operation and reduces development difficulty.

Figure 3:
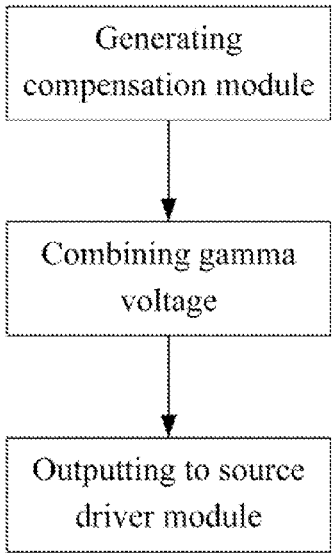
FIG. 3 is a flow diagram of a method of an example of the present disclosure.

The changed voltage of the common electrode voltage VCOM_FB is generated by the capacitor C and is mainly consists of alternating current (AC) voltage. Thus, direct current (DC) voltage of the common electrode voltage VCOM_FB is filtered by the C, the AC voltage of the changed voltage is directly received, and interference of the DC voltage is eliminated, which makes feedback results accurate. As shown in FIG. 3, the present disclosure further provides a data driving method for an LC panel, comprising the following steps:

A. detecting and obtaining a changed voltage of a common electrode voltage to generate a compensation voltage;

B. combining the compensation voltage and a gamma voltage, then sending the combined voltage to a source driver module.

In the step A, the common electrode voltage is filtered, and then a changed voltage of the common electrode voltage is calculated. The changed voltage of the common electrode voltage is generated by a capacitor and is mainly consists of alternating current (AC) voltage. Thus, direct current (DC) voltage of the common electrode voltage is filtered by the capacitor, the AC voltage of the changed voltage is directly received, and interference of the DC voltage is eliminated, which makes obtaining feedback results accurate.

In the step B, performing compensation in a ratio of 1:1, where the compensation voltage is equal to the changed voltage of the common electrode voltage. In the technical scheme, because the compensation voltage is equal to the changed voltage of the common electrode voltage, the source driver module can directly combine the output voltage of the comparator and the voltage of the data driver to drive corresponding data line without additional voltage conversion, which simplifies logical operation and reduces development difficulty.

If there are a plurality of gamma voltages, in the step B, combining the compensation voltage and a maximum gamma voltage, then sending the combined voltage to the source driver module. In practical application, there may be a plurality of the gamma voltages. To reduce design difficulty, the gamma voltages can appointed as one or several gamma voltages to be fed back to the comparator. For example, in the technical scheme, if only one gamma voltage is fed back, the maximum gamma voltage of the voltages is selected. Because all the gamma voltages are generated by a resistance division mode, when the maximum gamma voltage can be used to effectively compensate, the maximum gamma voltage is indirectly compensated onto other gamma voltages, and then crosstalk is effectively reduced.

Figure 4:
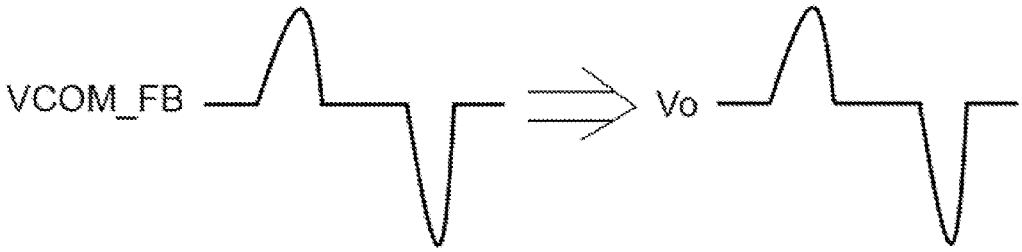
FIG. 4 is a waveform diagram of an example of the present disclosure.

Technical personnel of a technical field can calculate by the circuit of the comparator that: a voltage of an inverting input end of the comparator $V-=Vo*R1/(R1+R2)$, $(\Delta VCOM_FB-V+)/R3=(V+-GAM)/R4$, (V+ is a voltage of a non-inverting input end of the comparator), and $V-=V+$, where $\Delta VCOM_FB$ is the AC voltage of the common electrode voltage VCOM_FB. When $R1=R2$, $R3=R4$, the comparator output voltage $Vo=GAM+\Delta VCOM_FB$ (because of a production condition difference of the LCD panels, most of a practical situation may not meet the condition, and a resistance selection should be specially designed). When the capacitor coupling effect causes the common electrode voltage on the LCD panel to generate a ripple voltage, the voltage compensation module combines a VCOM_FB ripple voltage (namely the changed voltage of the common electrode voltage) and the gamma voltage, then the voltage compensation module outputs a combined. It can be seen from a VCOM_FB waveform and a Vo waveform shown in FIG. 4 that the Vo and the practical VCOM ripple voltage are mutually counteracted, thereby prohibiting crosstalk from being generated.

When the gamma calibration module outputs a plurality of gamma voltages, the gamma voltages are appointed as one or several gamma voltages, and different gamma voltages correspond to different compensation modules. Thus, accurate compensation is achieved. To reduce design difficulty, the maximum gamma voltage can be selected to be connected to the compensation module. Therefore, only one compensation module is needed, and then cost is lower. Because all the gamma voltages are generated by a resistance division mode, when the maximum gamma voltage can be used to effectively compensate, the maximum gamma voltage is indirectly compensated onto other gamma voltages, and then crosstalk is effectively reduced.

The present disclosure is described in detail in accordance with the above contents with the specific preferred examples. However, this present disclosure is not limited to the specific examples. For the ordinary technical personnel of the technical field of the present disclosure, on the premise of keeping, the conception of the present disclosure, the technical personnel can also make simple deductions or replacements, and all of which should be considered to belong to the protection scope of the present disclosure.

The invention claimed is:

1. A data driver circuit for a liquid crystal display (LCD) panel, comprising:

a source driver module;

a pixel electrode;

a common electrode opposite to the pixel electrode;

a gamma calibration module coupled to the source driver module, wherein the source driver module is coupled to the pixel electrode; and a compensation module that detects and obtains a changed voltage of the common electrode voltage to generate a compensation voltage, and combines the compensation voltage and a gamma voltage of the gamma calibration module, then sends the combined voltage to the source driver module, wherein the compensation module comprises a comparator, and an output end of the comparator is coupled to the source driver module;

a first resistor and a second resistor are connected in series between a grounding end of the data driver circuit and the output end of the comparator;

an inverting input end of the comparator is coupled between the first resistor and the second resistor;

a third resistor is connected in series between a non-inverting input end of the comparator and the common electrode; and a fourth resistor is connected in series between the non-inverting input end of the comparator and the gamma voltage.

2. The data driver circuit for the LCD panel of claim 1, wherein the gamma calibration module outputs at least two gamma voltages, the compensation module combines the compensation voltage and a maximum gamma voltage, and the combined voltage is sent to the source driver module.

3. The data driver circuit for the LCD panel of claim 1, wherein the gamma calibration module outputs at least two voltages, and the fourth resistor is coupled to an output end of the gamma calibration module that outputs a maximum gamma voltage.

4. The data driver circuit for the LCD panel of claim 1, wherein resistance of the first resistor is equal to resistance of the second resistor, and resistance of the third resistor is equal to resistance of the fourth resistor.

5. The data driver circuit for the LCD panel of claim 4, wherein the gamma calibration module outputs at least two voltages, and the fourth resistor is coupled to the output end of the gamma calibration module that outputs the maximum gamma voltage.

6. The data driver circuit for the LCD panel of claim 1, wherein a capacitor is connected in series between the third resistor and the common electrode.

7. The data driver circuit for the LCD panel of claim 6, wherein the gamma calibration module outputs at least two voltages, and the fourth resistor is coupled to an output end of the gamma calibration module that outputs a maximum gamma voila.

8. A liquid crystal display (LCD) device, comprising:

a data driver circuit comprises a source driver module, a pixel electrode, a common electrode opposite to the pixel electrode, a gamma correction module coupled to the source driver module, and a compensation module;

the source driver module is coupled to the pixel electrode;

the compensation module detects and obtains a changed voltage of the common electrode voltage to generate a compensation voltage, and combines the compensation voltage and a gamma voltage of the gamma calibration module, then sends the combined voltage to the source driver module, wherein the compensation module comprises a comparator, and an output end of the comparator is coupled to the source driver module;

a first resistor and a second resistor are connected in series between a grounding end of the data driver circuit and the output end of the comparator;

an inverting input end of the comparator is coupled between the first resistor and the second resistor;

a third resistor is connected in series between a non-inverting input end of the comparator and the common electrode; and a fourth resistor is connected in series between the non-inverting input end of the comparator and the gamma voltage.

9. The LCD device of claim 8, wherein the gamma calibration module outputs at least two voltages, and the fourth resistor is coupled to the output end of the gamma calibration module Which outputs the maximum gamma voltage.

10. The LCD device of claim 9, wherein the gamma calibration module outputs at least two voltages, and the fourth resistor is coupled to an output end of the gamma calibration module that outputs a maximum gamma voltage.

11. The LCD device of claim 9, wherein resistance of the first resistor is equal to resistance of the second resistor, and resistance of the third resistor is equal to resistance of the fourth resistor.

12. The LCD device of claim 11, wherein the gamma calibration module outputs at least two voltages, and the fourth resistor is coupled to the output end of the gamma calibration module which outputs the maximum gamma voltage.

13. The LCD device of claim 9, wherein a capacitor is connected in series between the third resistor and the common electrode.

14. The LCD device of claim 13, wherein the gamma calibration module outputs at least two voltages, and the fourth resistor is coupled to an output end of the gamma calibration module that outputs a maximum gamma voltage.

* * * * *